US011053795B2

(12) United States Patent
Kwak et al.

(10) Patent No.: US 11,053,795 B2
(45) Date of Patent: Jul. 6, 2021

(54) COMPRESSOR

(71) Applicants: Hanon Systems, Daejeon (KR); TE Connectivity Germany GmbH, Bensheim (DE)

(72) Inventors: Jung Myung Kwak, Daejeon (KR); Yong Hee Kim, Daejeon (KR); Daniel Domke, Frankenthal (DE); Simon Schemer, Speyer (DE); Peter Kurt Zawadzky, Kerzenheim (DE)

(73) Assignees: TE CONNECTIVITY GERMANY GMBH, Bensheim (DE); HANON SYSTEMS, Daejeon (KR)

( * ) Notice: Subject to any disclaimer, the term of this patent is extended or adjusted under 35 U.S.C. 154(b) by 0 days.

(21) Appl. No.: 16/803,492

(22) Filed: Feb. 27, 2020

(65) Prior Publication Data

US 2020/0277945 A1 Sep. 3, 2020

(30) Foreign Application Priority Data

Feb. 28, 2019 (KR) ..... 10-2019-0023877

(51) Int. Cl.
*F01B 31/12* (2006.01)
*F01B 3/00* (2006.01)

(52) U.S. Cl.
CPC ..... *F01B 3/0017* (2013.01); *F01B 31/12* (2013.01)

(58) Field of Classification Search
CPC ..... F01B 3/0017; F01B 31/12; F15B 15/2892
See application file for complete search history.

(56) References Cited

U.S. PATENT DOCUMENTS 4,839,591 A * 6/1989 Nomura ..... F15B 15/2807 324/207.13
6,991,435 B2 * 1/2006 Ochiai ..... F04B 27/1804 417/222.1
2012/0291622 A1 * 11/2012 Ikeda ..... F04B 27/18 91/1

FOREIGN PATENT DOCUMENTS

JP 5414115 B2 2/2014

* cited by examiner

*Primary Examiner* — F Daniel Lopez
(74) *Attorney, Agent, or Firm* — Shumaker, Loop & Kendrick, LLP; James D. Miller

(57) ABSTRACT

A compressor having a front housing in which a crank chamber is formed. A cylinder block is coupled to an opposite surface facing the front housing and includes reciprocating pistons in a plurality of cylinder bores. A rear housing is coupled to an opposite surface facing the cylinder block, the rear housing includes a suction chamber and a discharge chamber formed therein. A rotating shaft 400 is inserted via centers of the front housing and the cylinder block, the shaft inserted into a swash plate. A diameter maintenance part is configured to constantly maintain a diameter based on an axis direction of the piston 220. A sensor part is configured to sense a speed and a stroke of the piston in accordance with a change in position of a position determination part positioned on one side of the diameter maintenance part.

10 Claims, 9 Drawing Sheets

COMPRESSOR

CROSS-REFERENCE TO RELATED APPLICATION(S)

This patent application claims priority to Korean Patent Application No. 10-2019-0023877, filed on Feb. 28, 2019 the disclosure of which is incorporated herein by reference in its entirety.

FIELD

Exemplary embodiments of the present disclosure relate to a compressor, and more particularly, to a compressor for accurately sensing a stroke in accordance with a movement of a piston.

BACKGROUND

A cooling system of a vehicle includes a compressor, a condenser, an expansion valve, and an evaporator, and is configured to compress a refrigerant gas, discharged from the evaporator, into a high temperature high pressure state to easily liquefy the refrigerant gas, to transfer the compressed refrigerant gas to the condenser. In addition, the compressor serves to pump and recirculate the refrigerant so as to maintain the cooling.

The condenser cools and liquefies the high temperature high pressure refrigerant gas through heat exchange between the refrigerant gas and an outdoor air, and the expansion valve serves to change the liquid refrigerant to a state, in which the liquid refrigerant can be easily evaporated in the evaporator, by dropping the temperature and the pressure of the liquid refrigerant through adiabatic expansion of the liquid refrigerant.

The evaporator evaporates the liquid refrigerant by absorbing heat from the liquid refrigerant through heat exchange between the liquid refrigerant and the outdoor air introduced indoors, and the outdoor air is cooled by a heat loss through the heat exchange with the refrigerant and is blown to the interior of the vehicle by a blower.

The compressor is classified into a reciprocating type in which a portion that compresses a working fluid (refrigerant) reciprocates to perform the compression and a rotating type in which the portion is rotated to perform the compression.

The reciprocating type compressor is classified into a crank type in which a drive force of a drive source is transferred to a plurality of pistons using a crank, a swash plate type in which the drive force is transferred to a rotating shaft on which a swash plate is installed, and a wobble plate type using a wobble plate.

Among them, the swash plate type compressor is classified into a fixed type in which an angle of the swash plate is constantly fixed and a variable type in which the angle of the swash plate is varied.

The variable swash plate type compressor in the related art will be described with reference to the drawing.

Referring to FIG. 1, a variable swash plate type compressor 1 in the related art includes a drive shaft 20 provided inside a housing, a swash plate 26 installed on the drive shaft 20 to be integrally rotated with the drive shaft 20 and having an adjustable angle, a piston 14 connected to the swash plate 26 and configured to reciprocate back and forth to interlock with the rotation of the swash plate 26, and a pulley 70 installed at a front end portion of the drive shaft 20 and configured to receive a drive force transferred from an engine via a belt.

An external appearance of the compressor is composed of a cylinder block 10, and a front housing 32 and a rear housing 60 installed on both sides of the cylinder block 10. A plurality of cylinder bores 11 are formed on the cylinder block 10 in a circumferential direction, and the piston 14 is inserted into the cylinder bores 11.

A connection part 18 formed at one end portion of the piston 14 is connected to the swash plate 26 via a shoe 19, and the swash plate 26 is connected to a rotor 22 mounted on the drive shaft 20 to be integrally rotated with the drive shaft 20.

A drive part of the variable swash plate type compressor includes the drive shaft 20, the rotor 22 mounted on the drive shaft 20, and the swash plate 26 slidably installed on the drive shaft 20 and connected to the rotor 22.

A connection arm 28 of the swash plate 26 is connected to a hinge arm 24 formed on the rotor 22 by a hinge pin, and the hinge pin is installed in a hinge slot 24' formed on the hinge arm 24 to make it possible to change an inclination angle of the swash plate 26.

The pulley 70 is mounted at an end portion of the drive shaft 20, and is connected to an engine side pulley by a belt (not illustrated) to be rotated in accordance with an engine operation.

For example, if an engine power is transferred and the pulley 70 is rotated, the drive shaft 20, the rotor 22, and the swash plate 26 are rotated, and in interlock with the rotation, the piston 14 moves back and forth within the cylinder bore 11 to compress a refrigerant inside the cylinder bore 11.

A control valve 80 is installed on the rear housing 60, and connects a discharge chamber 3 from which the compressed refrigerant is discharged, a suction chamber 62, and a crank chamber 31, which is an inner space of the front housing 32, to one another.

The refrigerant pressure of the crank chamber 31 is adjusted by the control valve 80 in accordance with a cooling load, and in accordance with an increase in pressure of the crank chamber 31, the inclination angle of the swash plate 26 is reduced (rotated in a direction at a right angle to the drive shaft 20), and the stroke of the piston 14 is also reduced.

Accordingly, if the cooling load is large, the stroke of the piston 14 is controlled to be increased to increase a refrigerant discharge amount by increasing the inclination angle of the swash plate 26 through the decrease in the pressure of the crank chamber 31, whereas if the cooling load is small, the stroke of the piston 14 is controlled to be reduced to reduce the refrigerant discharge amount by reducing the inclination angle of the swash plate 26 through the increase in the pressure of the crank chamber.

The variable swash plate type compressor used as described above has problems in that it is difficult to measure an accurate stroke when the piston 14 is reciprocating, and thus it is not possible to accurately compensate for an engine load in accordance with the occurrence of various loads.

Recently, although various methods for measuring the accurate stroke in accordance with the movement of the piston have been attempted, sensing accuracy in accordance with the stroke of the piston deteriorates.

RELATED ART DOCUMENT

Patent Document 1) JP 5414115B2 (registered on Nov. 22, 2013).

SUMMARY

The present disclosure overcomes the above problems and other disadvantages not described above, and provides a compressor capable of accurately sensing a stroke in accordance with a movement of a piston and operating to accurately sense the position of the piston through an accurate conversion of sensed data into a digital signal.

Other aspects and advantages of the present disclosure can be understood by the following description, and become apparent with reference to embodiments of the present disclosure. Also, it is obvious to those skilled in the art to which the present disclosure pertains that the aspects and advantages of the present disclosure can be realized by the means as claimed and combinations thereof.

In accordance with a first embodiment of the present disclosure, a compressor includes: a front housing 100 in which a crank chamber 102 is formed; a cylinder block 200 which is coupled to an opposite surface facing the front housing 100 and in which a piston 220 is deployed to perform a reciprocating motion inside a plurality of cylinder bores 210 along an inner circumferential direction; a rear housing 300 which is coupled to an opposite surface facing the cylinder block 200 and in which a suction chamber 310 and a discharge chamber 320 are formed; a rotating shaft 400 which is inserted via centers of the front housing 100 and the cylinder block 200 and into which a swash plate 50 is inserted; a diameter maintenance part or outer wall 222 of the piston 220 includes a coating configured to constantly maintain a surface of the piston 220 in an axis direction of the piston 220; and a sensor part 500 configured to sense a speed and a stroke of the piston in accordance with a change in position of a position determination part 221 positioned on one side of the diameter maintenance part 222.

A distance B of the diameter maintenance part 222 from a conversion point P between the position determination part 221 and the diameter maintenance part 222 to an end of the piston is shorter than an axis-direction length A of the diameter maintenance part 222.

The sensor part 500 senses a change in a gap distance in a vertical direction when a sensor value being sensed in accordance with the reciprocating motion of the piston 220 moves from the position determination part 221 to the diameter maintenance part 222 or moves from the diameter maintenance part 222 to the position determination part 221.

When the piston 220 performs the reciprocating motion once, a virtual extension line DL, obtained by extending an axis-direction center of the sensor part 500, and the conversion point P meet each other twice.

If a sensing target of the sensor part 500 is the position determination part 221, data input through the sensor part 500 is input as a first magnetic field signal t1 over time t, and if the sensing target of the sensor part 500 is the diameter maintenance part 222, the data input through the sensor part 500 is input as a second magnetic field signal t2 over the time t, wherein the second magnetic field signal t2 is detected to be at a higher level than the first magnetic field signal t1.

A coating layer 222*a* is formed on the diameter maintenance part 222 so that a surface thereof is evenly maintained.

The compressor further includes an operation part 700 configured to receive data sensed by the sensor part 500 and to operate in real time the speed and the stroke of the piston.

In accordance with a second embodiment of the present disclosure, a compressor includes: a front housing 100 in which a crank chamber 102 is formed; a cylinder block 200 which is coupled to an opposite surface facing the front housing 100 and in which a piston 220 is deployed to perform a reciprocating motion inside a plurality of cylinder bores 210 along an inner circumferential direction; a rear housing 300 which is coupled to an opposite surface facing the cylinder block 200 and in which a suction chamber 310 and a discharge chamber 320 are formed; a rotating shaft 400 which is inserted via centers of the front housing 100 and the cylinder block 200 and into which a swash plate 50 is inserted; and a sensor part 500 configured to sense a speed and a stroke of the piston in accordance with a change in position of the piston 220, wherein the sensor part 500 includes: a body part 510 configured to form an external appearance and formed of an insulator; and a support part 520 provided with a fixing part 522 inserted in an axis direction of the body part 510 to fix the body part 510 to prevent the secession of the body part 510 and fix the body part 510, and configured to couple the body part 510 to the cylinder block 200.

The sensor part 500 is positioned on an upper side in a gravity direction based on a center of gravity of the compressor.

A step height 511 is formed on the body part 510 to project outward, and a groove 521 inwardly recessed to correspond to the step height 511 is formed in the support part 520.

The fixing part 522 is formed to be bent inwardly to surround the step height 511 of the body part 510.

A retainer 40 for preventing the secession of the body part 510 is installed on the body part 510 using a tension in a circumferential direction of the body part 510.

A sealing member 502 is installed between the body part 510 and the cylinder block 200.

According to the compressor according to an embodiment of the present disclosure, it is possible to compensate for the engine load against the torque of the compressor by accurately performing the load control in accordance with the stroke according to the movement of the piston and the swash plate angle of the swash plate.

According to the compressor according to the present disclosure, because the accurate sensing in accordance with the stroke of the piston and the signal conversion are stably performed, and the period and the duty ratio can be accurately operated without errors, the control stability of the compressor is improved.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION OF THE EMBODIMENTS

Figure 1:
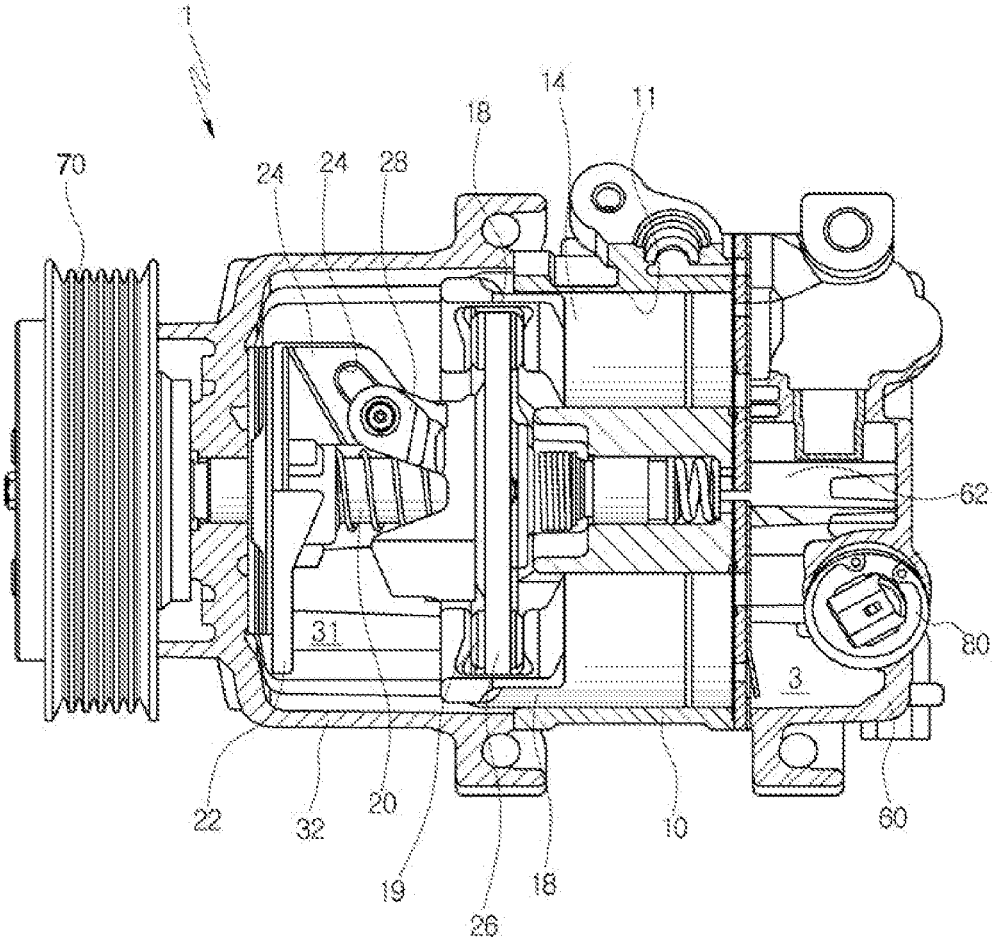
FIG. 1 Prior Art
FIG. 1 is a cross-sectional view illustrating a variable swash plate type compressor in the related art.
Figure 2:
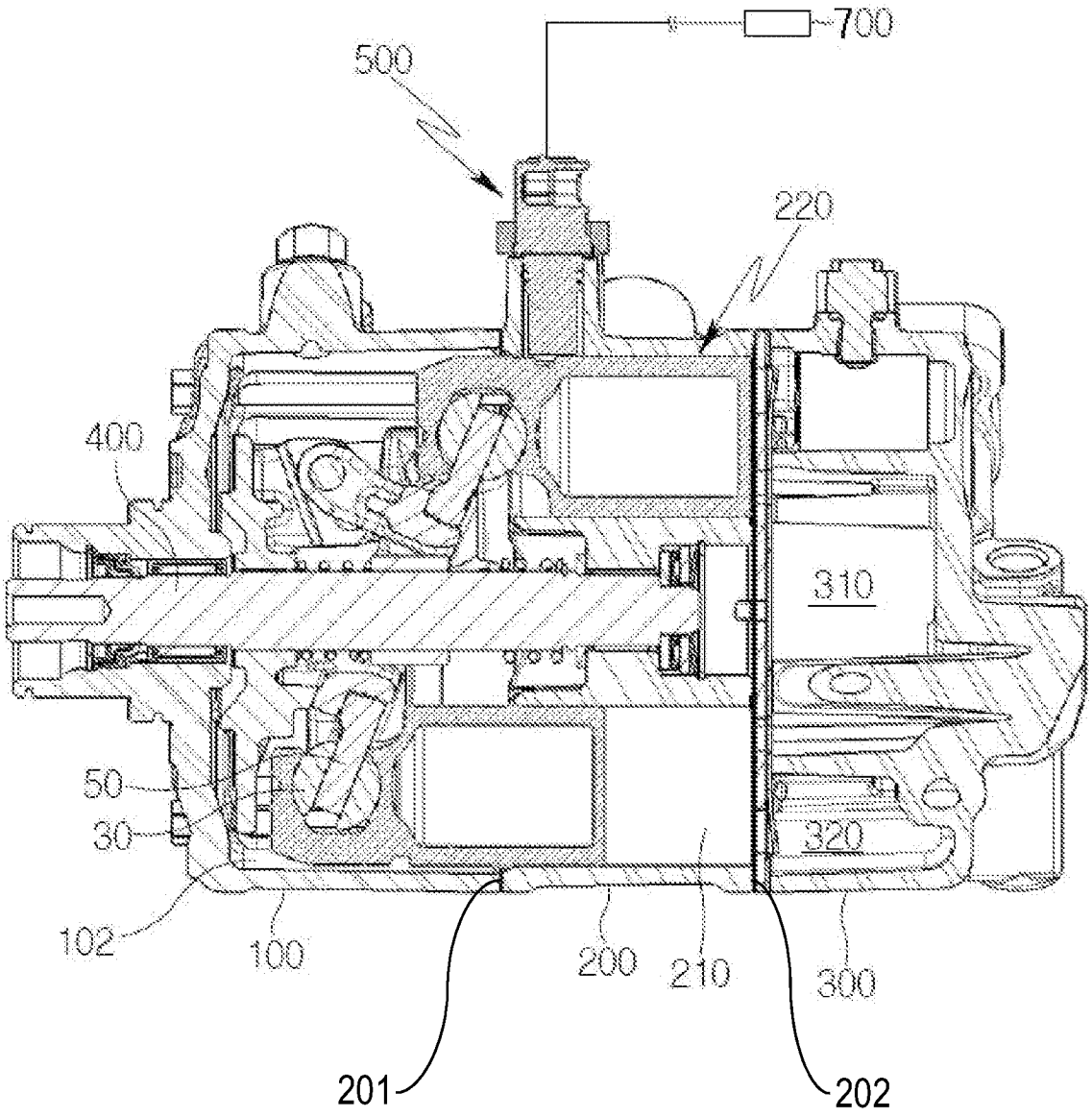
FIG. 2 is a cross-sectional view illustrating a compressor according to a first embodiment of the present disclosure.

A compressor according to a first embodiment of the present disclosure will be described with reference to accompanying drawings. FIG. 2 is a cross-sectional view illustrating a compressor according to a first embodiment of the present disclosure, FIG. 3 is a perspective view illustrating a piston provided in the compressor according to the first embodiment of the present disclosure, and FIG. 4 is a longitudinal cross-sectional view of FIG. 3.

Figure 3:
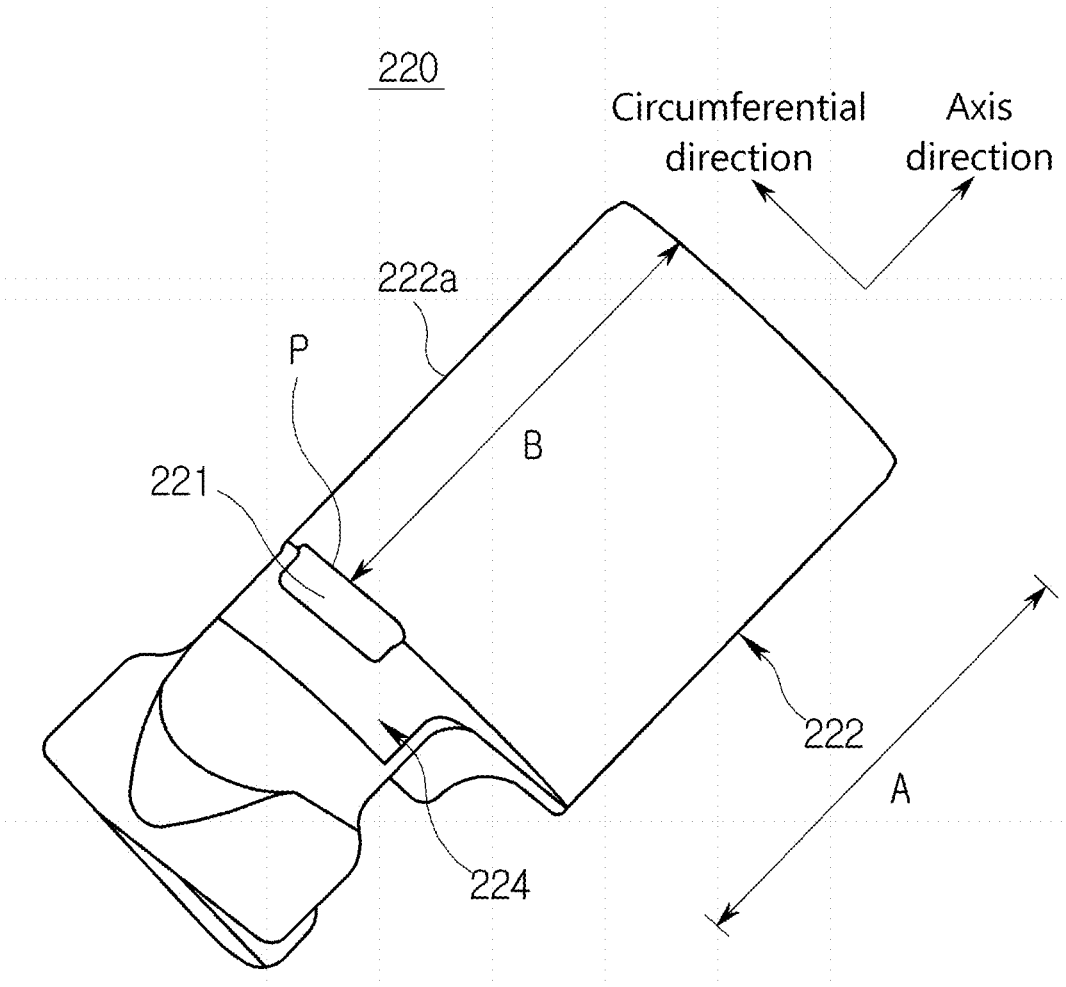
FIG. 3 is a perspective view illustrating a piston provided in the compressor according to the first embodiment of the present disclosure.
Figure 4:
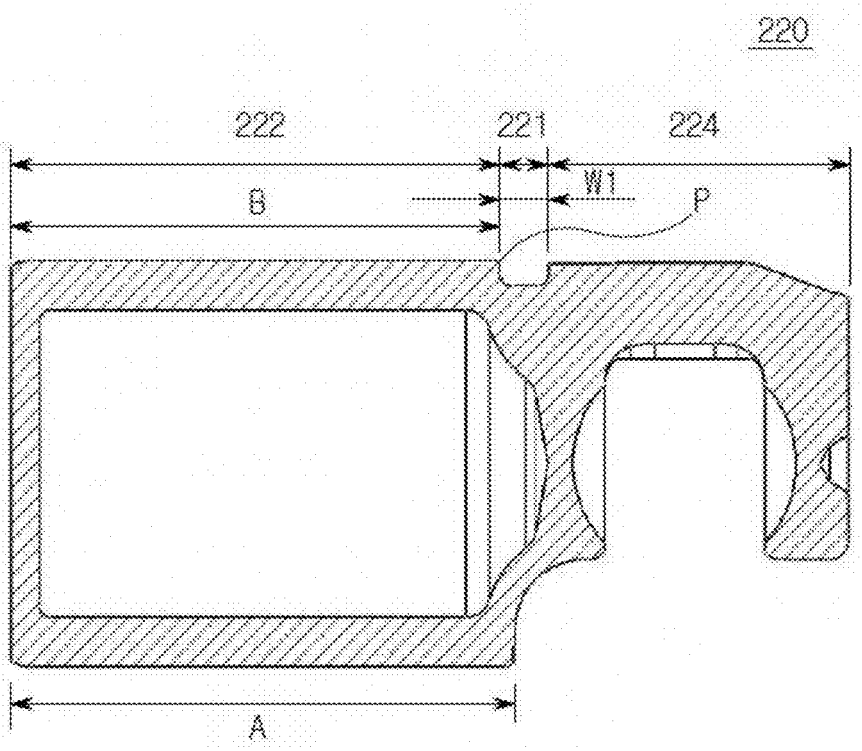
FIG. 4 is a longitudinal cross-sectional view of FIG. 3.

Referring to FIGS. 2 to 4, the compressor according to the first embodiment of the present disclosure intends to improve a fuel economy by accurately measuring stroke data of a piston 220 in accordance with a swash plate angle of a swash plate when the compressor operates under various load conditions and compensating for a torque in accordance with a variation in load of the compressor through real time monitoring.

Further, the present embodiment intends to implement a stable and efficient operation of the compressor by accurately measuring a gap distance between the pistons 220 through a sensor part 500 to be described later and calculating an accurate position of the piston 220 in accordance with a stroke of the piston 220.

To this end, the compressor according to the present embodiment is provided with a front housing 100 in which a crank chamber 102 is formed, a cylinder block 200 which is coupled to an opposite surface 201 facing the front housing 100 and in which the pistons 220 are deployed to perform a reciprocating motion inside a plurality of cylinder bores 210 along an inner circumferential direction, and a rear housing 300 which is coupled to an opposite surface 202 facing the cylinder block 200 and in which a suction chamber 310 and a discharge chamber 320 are formed.

The front housing 100, the cylinder block 200, and the rear housing 300 form an external appearance of the compressor.

Further, the compressor is provided with a rotating shaft 400 which is inserted via centers of the front housing 100 and the cylinder block 200 and into which a swash plate 50 is inserted. The swash plate 50 is provided with a shoe 30 provided at an end portion in a radius direction of the swash plate 50.

Further, the compressor includes a diameter maintenance part or outer wall 222 having a coating layer formed thereon configured to constantly maintain a surface of the piston 220 in an axis direction of the piston 220, the diameter maintenance part formed at a first end of the piston 220 adjacent the rear housing 300. The compressor further including a sensor part 500 configured to sense a speed and a stroke of the piston 220 in accordance with a change in position of a position determination part 221 positioned on one side of the diameter maintenance part 222 as the piston 220 performs the reciprocating motion in the axis direction of the cylinder bores 210.

Further, the compressor includes an operation part 700 configured to receive data sensed by the sensor part 500 and to operate in real time the current speed and stroke of the piston 220.

The position determination part 221 in which a groove having a predetermined length is formed in a circumferential direction of the piston 220 is provided at a front end portion of the piston 220 whose diameter is constantly maintained with a predetermined length based on an axis direction.

Because the position determination part 221 having the predetermined length is formed at a position facing the sensor part 500 in the circumferential direction of the piston 220 and maintains a height difference from the diameter maintenance part 222, the sensor part 500 can sense the position of the piston 220 in accordance with the reciprocating motion of the piston 220.

The piston 220 includes a shoe coupling part 224 horizontally extending with a predetermined length toward a second and of the piston in a direction in which the front housing 100 is positioned, and being coupled to the shoe.

As an example of the sensor part 500 according to the present embodiment, a position sensor is used, and the detailed structure thereof will be described later. The sensor part 500 receives an electromagnetic field signal in accordance with a gap distance in a vertical direction when a sensor value being sensed in accordance with the reciprocating motion of the piston 220 moves from the position determination part 221 to the diameter maintenance part 222 or moves from the diameter maintenance part 222 to the position determination part 221.

In the present embodiment, the swash plate angle of the swash plate 50 is changed when the rotating shaft 400 is rotated in accordance with the load of the swash plate type compressor, and in accordance with the swash plate angle, the piston 220 performs the reciprocating motion in a section from the minimal point to the maximal point along the bores 210. In this case, accurate position data in accordance with the stroke of the piston 220 is input to the operation part 700, and the load control is performed in accordance with the operation state according to the load of the compressor.

The piston 220 is composed of the diameter maintenance part 222 and the shoe coupling part 224, and a coating layer 222*a* is formed on the diameter maintenance part 222 so that the surface thereof is uniformly maintained. The diameter maintenance part 222 constantly maintains the diameter of the outer circumferential surface thereof along the axis direction, and the coating layer 222*a* is formed thereon to maintain more precise tolerance.

The evenness of the surface of the piston 220 is constantly maintained by the coating layer 222*a*. Thus, if the position determination part 221 is positioned on the lower side of the sensor part 500 through movement of the piston 220, distance data being spaced apart in a vertical direction is sensed through the sensor part 500.

According to the present embodiment, because the surface of the position determination part 221 is constantly maintained and extends without being inclined in one-side direction, and a section in which the diameter thereof is changed is not formed, the sensor part 500 can sense an accurate position of the piston 220.

For example, if the surface of the position determination part 221 is uneven or is inclined in one-side direction, or the section in which the diameter thereof is changed is formed, the gap distance in a vertical direction between the sensor part 500 and the position determination part 221 is variously changed, and thus accuracy of analog data is degraded to cause a complicated conversion process to occur in the process of converting the analog data into digital data.

In the present embodiment, because the coating layer 222*a* is formed on the diameter maintenance part 222 as described above, the sensor part 500 can perform accurate sensing, error occurrence in the sensing process is reduced, and the accuracy of data is improved. Further, the load control of the compressor can be performed by calculating the accurate position in accordance with the stroke of the piston 220 through a simple conversion process.

In the piston 220 according to the present embodiment, the position determination part 221 is formed at the end portion of the diameter maintenance part 222 as described above. The position determination part 221 is formed at the above-described position to accurately perform a load amount control in accordance with the stroke of the piston 220 through accurate sensing of the position of the piston 220 by the sensor part 500.

The reason why the position determination part 221 is formed at the above-described position is to improve accuracy by providing accurate position data in accordance with the stroke of the piston 220 to the operation part 700.

As an example, a groove having a predetermined length is formed in the position determination part 221 in a circumferential direction of the piston 220, and the position determination part 221 extends with a predetermined length in the axis direction. The position determination part 221 is provided for a position sensor, provided in the sensor part 500, to accurately discriminate between the positions of the diameter maintenance part 222 and the shoe coupling part 224 and to acquire accurate data in accordance with the positions, and to provide a switching point when a boundary discrimination in accordance with the height difference among the position determination part 221, the diameter maintenance part 222, and the shoe coupling part 224 is converted into an analog signal.

The sensor part 500 is provided with a coil (not illustrated) therein, and can accurately measure and operate the stroke of the piston 220, provided in the compressor, by sensing eddy current occurring differently in accordance with the gap distance from the position determination part 221 or the diameter maintenance part 222 under the condition that current is applied to the coil.

Because the data sensed by the sensor part 500 is used as important data for a load control of the compressor, the data is used to diagnose the current status of the compressor, and it is possible to efficiently operate the compressor through a control of the rpm of the compressor.

The sensor part 500 senses the eddy current, and the eddy current value is converted into an analog signal to be finally converted into a PWM signal.

In order to sense accurate data, the sensor part 500 first senses analog distance data being spaced apart from the surface of the reciprocating piston 220. In this case, it is advantageous for the accurate sensing that the piston 220 is positioned maximally close to the sensor part 500, and it is advantageous for the accurate operation during conversion into a digital signal that different data are sensed in accordance with the difference in accordance with the gap distance and the positions of the diameter maintenance part 222, the position determination part 221, and the shoe coupling part 224.

In the present embodiment, the position determination part 221 is positioned on the lower side of the sensor part 500, and if the swash plate angle of the swash plate 50 is changed, it accurately provides a switching point in accordance with forward or backward movement of the piston 220 as an analog signal.

In particular, the position determination part 221 is formed on the inside that is deeper than the surface of the diameter maintenance part 222 or the shoe coupling part 224, and thus it can be accurately discriminated when the analog signal sensed by the sensor part 500 is converted into a digital signal.

Further, the sensor part 500 is advantageous for the load control and torque compensation of the compressor through an accurate data measurement in accordance with the change in stroke of the piston 220, and thus the fuel economy can be finally improved.

For reference, because evenness of each of opposite surfaces of the diameter maintenance part 222 and the shoe coupling part 224, facing the sensor part 500 in the axis direction of the piston 220, is constantly maintained, and only the position determination part 221 has the groove formed inside the piston 220, the sensor part 500 can accurately sense the gap distance therebetween.

In the present embodiment, the position determination part 221 is formed with the same depth in the axis direction and in the circumferential direction of the piston 220. In this case, all the sensing ranges of the position sensor provided in the sensor part 500 can be satisfied, and thus it is possible to acquire accurate data in accordance with the movement of the piston 220.

A distance B of the diameter maintenance part 222 from a conversion point P between the position determination part 221 and the diameter maintenance part 222 to an end of the piston is shorter than an axis-direction length A of the diameter maintenance part 222.

The position determination part 221 is positioned at an extended end portion of the diameter maintenance part 222 and maintains a specific height difference therebetween. As described above, the height difference is provided to sense the height difference through the position sensor provided in the sensor part 500, and the sensor part 500 can sense the accurate position in accordance with the movement of the piston 220 through the position determination part 221 maintaining the height that is different from the heights of the surfaces of the diameter maintenance part 222 and the shoe coupling part 224.

The sensor part 500 is inserted from an outside to an inside of the cylinder block 200, and based on the drawing, the sensor part 500 is positioned on the left side adjacent to the front housing 100 based on the axis direction of the cylinder block 200.

The position corresponds to the above-described position at which the position determination part 221 and the sensor part 500 face each other in the axis direction, and because the position corresponds to the optimum position for sensing the position of the position determination part 221, the sensor part 500 is positioned at the position illustrated in the drawing.

Figure 5:
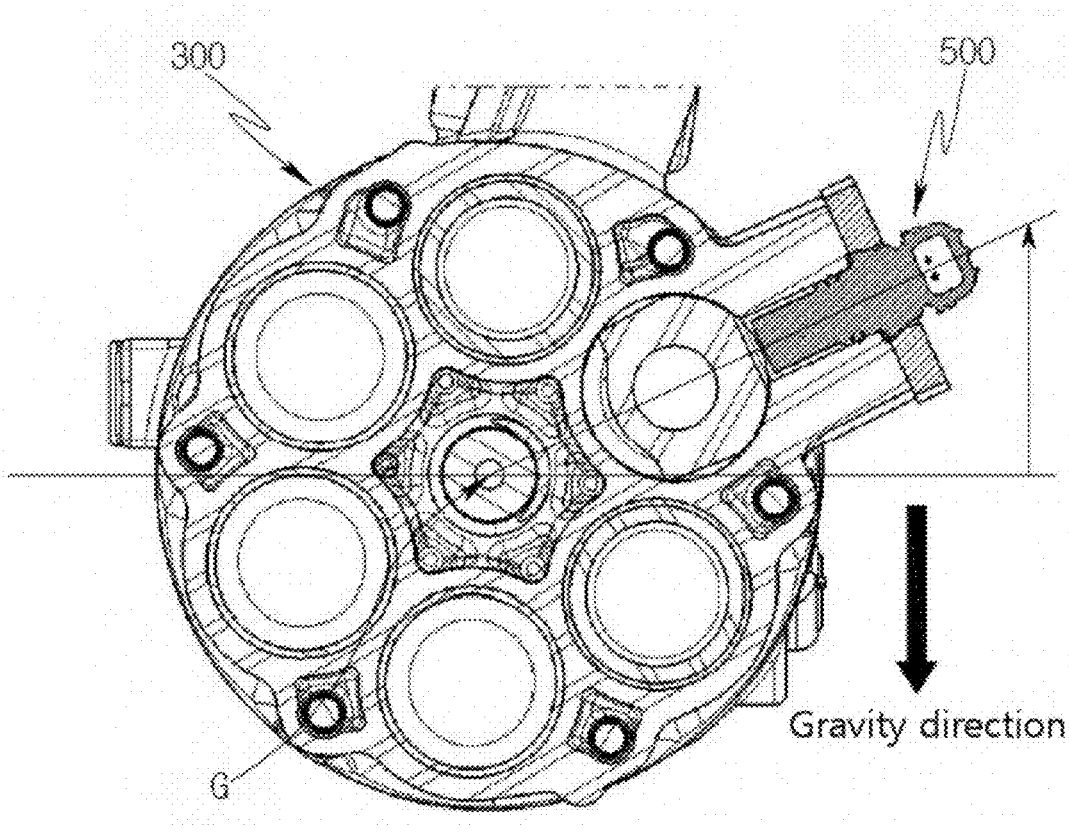
FIG. 5 is a view illustrating an installation position of a sensor part installed on the compressor according to the first embodiment of the present disclosure.

FIG. 5 is a view illustrating a state when seen from the rear housing. Referring to FIG. 5, the sensor part 500 is installed to be inclined upward (in a 2 o'clock direction corresponding to the right upper part based on the drawing) based on the center of gravity G of the rear housing 300. The sensor part 500 is installed as illustrated in the drawing so that the sensor part 500 does not soak in oil remaining inside the crank chamber 102 after the sensor part 500 is installed.

In particular, because the sensor part 500 is positioned in a direction opposite to the gravity direction and on the upper side of the piston 220, the sensor part 500 is prevented from malfunctioning, and can sense the position in accordance with the movement of the piston 220 stably and accurately.

Figure 6:
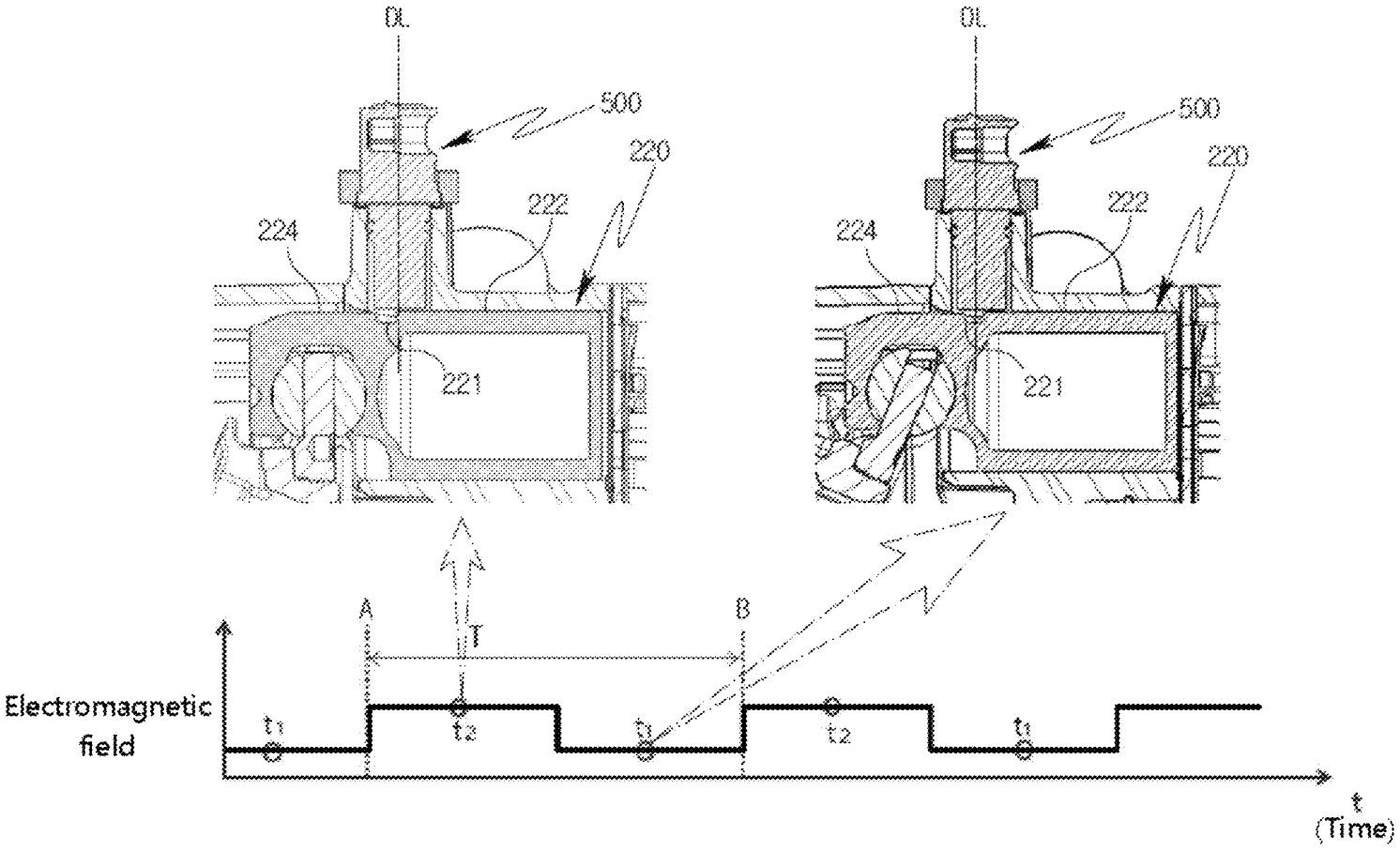
FIG. 6 is a graph illustrating an electromagnetic field signal, over time, of the compressor according to the first embodiment of the present disclosure.

FIG. 6 illustrates a state in which the piston is under the minimal stroke operation condition and the swash plate angle of the swash plate is operated within the minimal swash plate angle range.

For reference, in the graph illustrated in the drawing, an X axis corresponds to time, and a Y axis corresponds to an electromagnetic field.

Referring to FIG. 6, in the present embodiment, if the swash plate 50 is positioned at a right angle with respect to the rotating shaft 400 under the above-described condition, a virtual extension line DL obtained by extending an axis-direction center of the sensor part 500 is positioned at a front end portion of the piston 220. The front end portion corresponds to the diameter maintenance part 222, and the extension line DL is positioned on the diameter maintenance part 222.

If the piston 220 is under the minimal stroke operation condition, it corresponds to a case where the minimal load of the compressor occurs. Thus, the stroke of the swash plate 50 minimally moves in the axis direction of the rotating shaft 500 as illustrated in the drawing.

The extension line DL corresponds to an outer circumferential surface of the diameter maintenance part 222, not the position determination part 221, as described above, and the extension line DL obtained by extending the axis-direction center of the sensor part 500 is positioned on the sensor part 500 and the diameter maintenance part 222.

Further, if the piston 220 is under the minimal stroke operation condition and the piston 220 is positioned at the maximal point while moving along the bore 210, the virtual extension line DL obtained by extending the axis-direction center of the sensor part 500 is positioned on one side based on the width-direction center of the position determination part 221.

For example, if the piston 220 is under the minimal stroke operation condition and the piston 220 is positioned at the maximal point while moving along the bore 210, data input through the sensor part 500 in accordance with the vertical distance being spaced apart between the sensor part 500 and the position determination part 221 is input as a first magnetic field signal t1 over time t.

Further, if the swash plate 50 is positioned at a right angle with respect to the rotating shaft 400, the virtual extension line obtained by extending the axis-direction center of the sensor part 500 is positioned at the front end portion of the piston 220, and the data input through the sensor part 500 in accordance with the vertical distance being spaced apart between the sensor part 500 and the diameter maintenance part 222 is input as a second magnetic field signal t2 over the time t.

When the piston 220 operates at the minimal stroke, the first magnetic field signal t1 and the second magnetic field signal t2 are alternately repeated over the time t, and in the case of converting the signals into digital signals, the signals are clearly discriminated over the time t.

In the present embodiment, the second magnetic field signal t2 is detected to be at a higher level than the first magnetic field signal t1. The second magnetic field signal t2 corresponds to the diameter maintenance part 222, and if the position sensor provided in the sensor part 500 senses the corresponding eddy current, the eddy current appears as illustrated in the graph.

Because the second magnetic field signal t2 is detected to be at a higher level than the first magnetic field signal t1, and the signals t1 and t2 are repeated over the time, rpm information of the variable swash plate type compressor in accordance with the stroke of the swash plate 50 can be accurately acquired.

In particular, because the graph of the electromagnetic field over the time t is not complicated, but is repeated simply and clearly, it can be accurately reflected in the data for the load control of the compressor.

Further, the first magnetic field signal t1 according to the present embodiment is constantly maintained over the time, and then constantly maintained for a specific time after the electromagnetic field is vertically upward as the opposite surface facing the sensing part 500 is changed to the position determination part 221, through the movement of the swash plate 50, at the position of a boundary point A at which the second magnetic field signal t2 is sensed.

Then, at the position of a boundary point B, the movement trace of the graph described above is repeated again.

Under the minimal stroke operation condition of the piston 220, a section in which the first magnetic field signal t1 and the second magnetic field signal t2 are alternately repeated corresponds to a period T.

Because the period T corresponds to the time from the boundary point A to the boundary point B, and is repeated over the time, the speed and the stroke of the piston 220 can be operated in real time by the operation part 700, and be utilized as data for an accurate control of the section in which the piston 220 operates at the minimal stroke.

If it is assumed that a duty cycle is DC in a state where the piston 220 is under the minimal stroke operation condition, the DC is calculated as DC=t2/T (where t2 is the second magnetic field signal, and T is the period), and the duty cycle DC is calculated as 50%.

The operation part 700 operates that the swash plate 50 operates at a stroke of 50%, and thus can provide accurate data for the load control.

When the piston 220 performs the reciprocating motion once, the virtual extension line DL, obtained by extending the axis-direction center of the sensor part 500, and the conversion point P meet each other twice.

A compressor according to a second embodiment of the present disclosure will be described with reference to the drawings.

Figure 7:
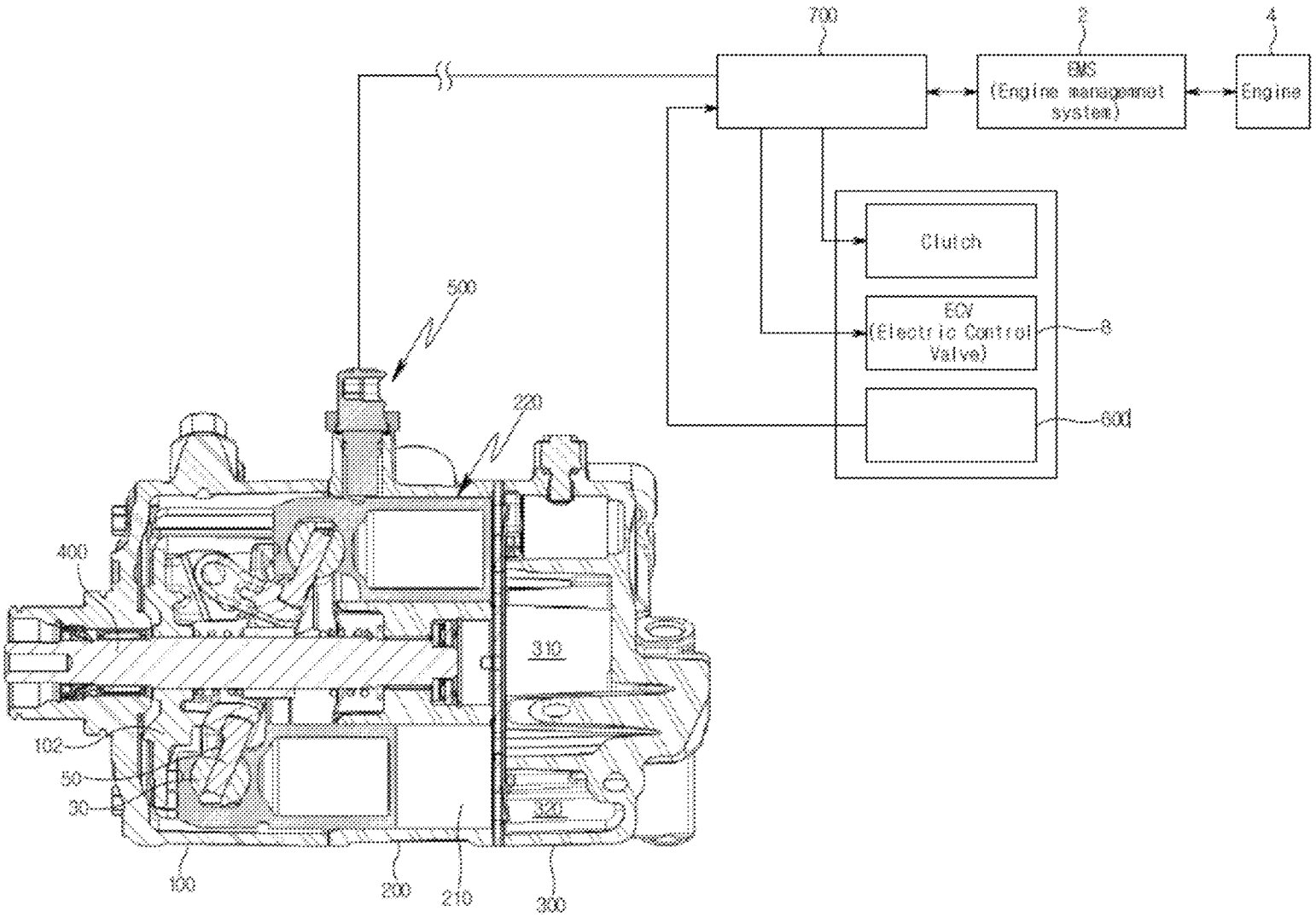
FIG. 7 is a diagram illustrating a configuration associated with a compressor and an operation part according to a second embodiment of the present disclosure.
Figure 8:
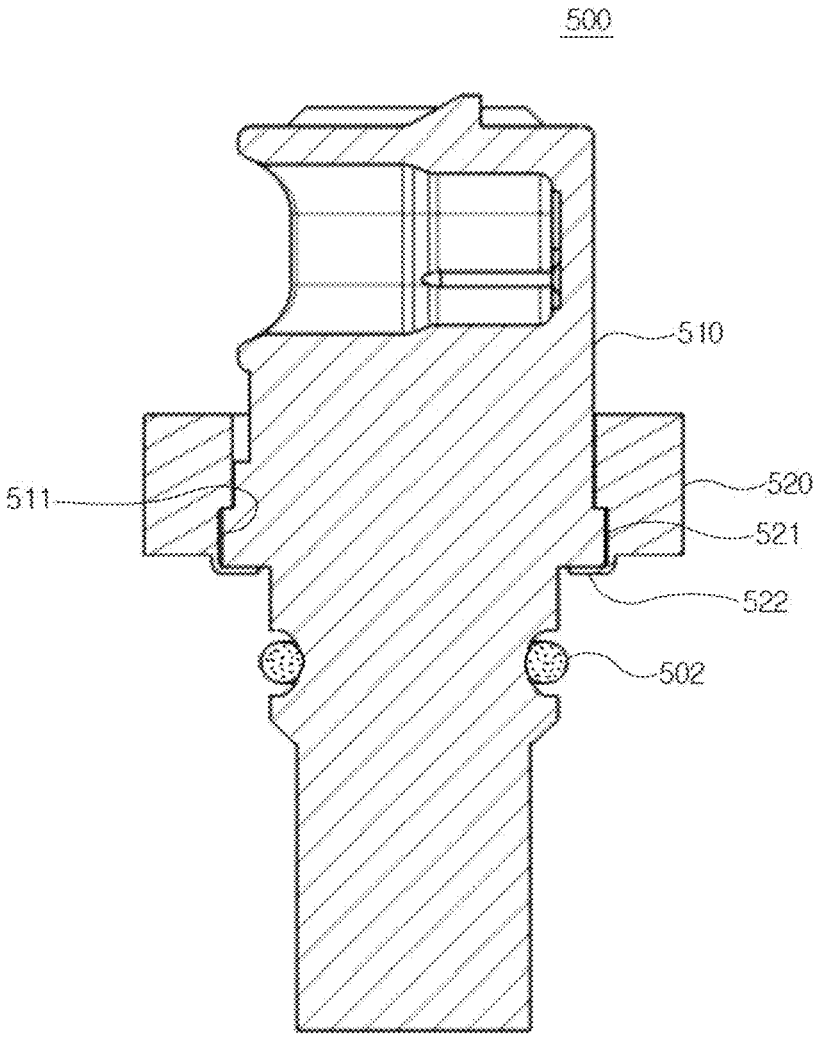
FIG. 8 is a longitudinal cross-sectional view illustrating a sensor part provided on the compressor according to the second embodiment of the present disclosure.
Figure 9:
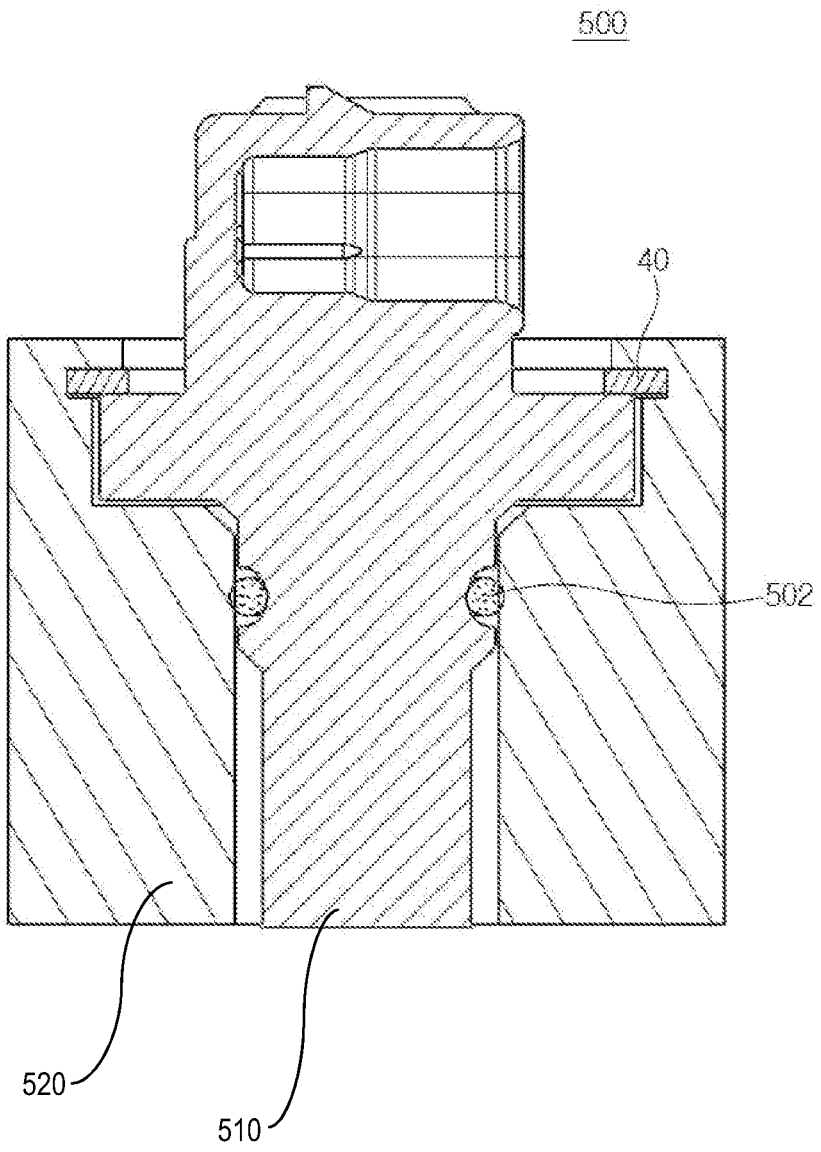
FIG. 9 is a longitudinal cross-sectional view illustrating the sensor part mounted by a retainer according to the second embodiment of the present disclosure.

Referring to FIGS. 7 to 9, a compressor according to the second embodiment of the present disclosure includes a front housing 100 in which a crank chamber 102 is formed, a cylinder block 200 which is coupled to an opposite surface facing the front housing 100 and in which a piston 220 is deployed to perform a reciprocating motion inside a plurality of cylinder bores 210 along an inner circumferential direction, a rear housing 300 which is coupled to an opposite surface facing the cylinder block 200 and in which a suction chamber 310 and a discharge chamber 320 are formed, a rotating shaft 400 which is inserted via centers of the front housing 100 and the cylinder block 200 and into which a swash plate 50 is inserted, and a sensor part 500 configured to sense a position change of the piston 220 from an outside of the cylinder block 200.

The sensor part 500 includes a body part 510 configured to form an external appearance and formed of an insulator, and a support part 520 provided with a fixing part 522 inserted in an axis direction of the body part 510 to fix the body part 510 to prevent the secession of the body part 510 and fix the body part 510, and configured to couple the body part 510 to the cylinder block 200.

In order for the sensor part 500 to stably sense the position of the piston 220 under the condition that eddy current occurs, the body part 510 is formed of a resin material that is an insulator.

The support part 520 is formed of a metal material, and is fixed by the fixing part 522 after the body part 510 is inserted. The fixing part 522 comes in close contact with a step 511 formed on a side surface of the body part 510 when seen from the side surface of the support part 520.

A sealing member 502 is installed between the body part 510 and the cylinder block 200, and as the sealing member 502, a rubber or a material that is minimally deformed under a high temperature condition may be used for sealing.

The fixing part 522 is formed to be bent inwardly to surround the step height 511 of the body part 510 and thus prevents secession and separation of the sensor part 500.

A groove 521 inwardly recessed to correspond to the step height 511 is formed in the support part 520, and the groove 521 and the step height 511 are engaged with each other to prevent the secession of the sensor part 500.

The support part 520 is formed of a metal material, and a retainer 40 for preventing the secession of the body part 510 is installed in the support part 520 using a tension in a circumferential direction of the body part 510, so that a gap occurrence is minimized, and the engaged state is stably maintained.

An operation part 700 operates period information and duty cycle information by converting analog data sensed by the sensor part 500 into digital data, operates the speed of the piston through the period information, and operates the stroke of the swash plate 50 through the duty cycle information.

In the present embodiment, the operation part 700 performs the load control of the compressor in the case where the piston 220 is at the minimal stroke and at the maximal stroke.

The operation part 700 operates in interlock with an engine control system 2, and the engine control system 2 receives a signal transferred from an engine 4 provided in a vehicle.

The operation part 700 receives data in accordance with the movement of the piston sensed by the sensor part 500 and transmits the received data to an electronic control valve (ECV) 8, and the speed and stroke information of the compressor sensed by a speed stroke sensor 600 is input to the operation part 700.

The ECV 8 controls the pressure of the crank chamber 102 through an inclination angle control of the swash plate 50, and varies the discharge capacity of the refrigerant.

In the present embodiment, the ECV control can be accurately performed using the accurate position of the piston 220 and the stroke data, which is advantageous for the torque control.

For example, the operation part 700 operates the period information and the duty cycle information based on the magnetic field signal sensed when the piston 220 is at the minimal stroke or the piston 220 is positioned at the minimal point or the maximal point and the magnetic field signal sensed when the piston 220 is at the maximal stroke or the piston 220 is positioned at the minimal point or the maximal point.

Further, because the load control can be stably performed using the stroke data according to the rpm of the compressor, more accurate and stable operation can be performed under a high load condition or under a low load condition.

Although preferred embodiments of the present disclosure have been described for illustrative purposes, the present disclosure is not limited by them, and those of ordinary skill in the art will appreciate that various modifications, additions and substitutions are possible, without departing from the scope and spirit of the disclosure as disclosed in the accompanying claims.

What is claimed is:

1. A compressor comprising:

a front housing in which a crank chamber is formed;

a rear housing in which a suction chamber and a discharge chamber are formed;

a cylinder block disposed between and coupled to the front housing and the rear housing, a plurality of cylinder bores formed in the cylinder block in a circumferential direction, a plurality of pistons reciprocatingly disposed in the plurality of cylinder bores, each of the plurality of pistons having an outer wall formed at a first end of each of the plurality of pistons, the outer wall including a coating layer formed thereon to uniformly maintain a surface of the outer wall, each of the plurality of pistons further including a shoe coupling part formed at a second end of each of the plurality of pistons;

a rotating shaft is rotatingly supported by the front housing and the cylinder block, and a swash plate is inserted on the rotating shaft; and a position determination part positioned on one side of the piston, with a conversion point P being a transition between the position determination part and the outer wall, wherein a first axial distance B, from the conversion point P to an end of the outer wall furthest from the conversion point, is shorter than an axis direction length of the outer wall, and a sensor part disposed in the cylinder block, which senses a radial gap distance between the sensor part and the piston, which changes at the conversion point P, to sense a change in position of the position determination part, wherein the sensor senses only the outer wall and the position determination part of the piston and not the shoe coupling part of the piston.

2. The compressor of claim 1, wherein when the piston performs the reciprocating motion once, a virtual extension line DL, obtained by extending an axis-direction center of the sensor part, and the conversion point P meet each other twice.

3. The compressor of claim 1, wherein when the sensor part senses the position determination part, data input is a first magnetic field signal t1, and when the sensor part senses the outer wall, data input is a second magnetic field signal t2, wherein the second magnetic field signal t2 is detected to be at a higher level than the first magnetic field signal t1.

4. The compressor of claim 1, further comprising an operation part configured to receive data sensed by the sensor part and to operate in real time the speed and the stroke of the piston.

5. The compressor of claim 1, wherein the sensor part includes:

a body part formed of an insulator; and a support part provided with a fixing part to fix the body part with respect to the support part to prevent a secession of the body part from the support part, and configured to couple the body part to the cylinder block.

6. The compressor of claim 5, wherein the sensor part is positioned on an upper side in a gravity direction.

7. The compressor of claim 5, wherein a step is formed on the body part to project outward, and a groove to correspond to the step height is formed in the support part.

8. The compressor of claim 7, wherein the fixing part is formed to be bent inwardly to surround the step.

9. The compressor of claim 5, wherein the fixing part is installed on the body part using a tension in a circumferential direction of the body part.

10. The compressor of claim 5, wherein a sealing member is installed between the body part and the cylinder block.

* * * * *